US005437127A

United States Patent [19]

Ha

[11] Patent Number: 5,437,127

[45] Date of Patent: Aug. 1, 1995

[54] STONE SURROUND FOR DEFINING A GRAVE SITE

[76] Inventor: Jang P. Ha, 8459 Brass Knob Ct., Annandale, Va. 22003

[21] Appl. No.: 235,514

[22] Filed: Apr. 29, 1994

[51] Int. Cl.[6] ..... E04H 13/00

[52] U.S. Cl. ..... 52/103; 52/102; 27/30; D99/20

[58] Field of Search ..... 52/102, 103, 606; 27/30; 47/33, 25; D99/17-20; 404/34; D25/113-115

[56] References Cited

U.S. PATENT DOCUMENTS

| | | | |
|---|---|---|---|
| D. 55,064 | 5/1920 | Lutz | D99/20 |
| 654,860 | 7/1900 | Tennant | 52/102 |
| 1,065,119 | 6/1913 | Early | 52/102 |
| 1,773,391 | 8/1930 | Cooney . | |
| 1,851,710 | 3/1932 | Lefeyre | 52/102 |
| 3,030,093 | 4/1962 | Reintjes | D25/113 X |
| 4,884,920 | 12/1989 | Perazzi | 47/33 |

FOREIGN PATENT DOCUMENTS

| | | | |
|---|---|---|---|
| 035998 | 12/1929 | France | 52/102 |

*Primary Examiner*—Carl D. Friedman
*Assistant Examiner*—Robert J. Canfield
*Attorney, Agent, or Firm*—Birch, Stewart, Kolasch & Birch

[57] ABSTRACT

A stone surround for defining a grave site, includes a rectangular stone wall structure, a stone front plate, and a pair of stone plates each having a hole respectively for growing plants therethrough from the ground.

3 Claims, 2 Drawing Sheets

10
11
12
13
14
15
16
17
18
19
20
21

STONE SURROUND FOR DEFINING A GRAVE SITE

BACKGROUND OF THE INVENTION

1. Field of the Invention

The present invention relates to a stone surround for defining a grave site and more particularly, to an improved bulging grass tomb surrounded with a rectangular stone wall and plants in front of the bulging grass tomb.

2. Description of Related Art

There are many types of grave forms which are well known in the art as exemplified by U.S. Pat. No. 1,773,391 to Cooney. However, these grave forms suffer from a number of disadvantages such as, for example, they are difficult to provide a bulging grass tomb, are complicated in structure, expensive to manufacture, and do not maintain positions for plants in front of the tomb.

SUMMARY OF THE INVENTION

Accordingly, it is an object of the present invention to provide a stone surround for defining a grave site, which eliminates the above problems encountered with conventional grave forms.

Another object of the present invention is to provide an improved bulging grass tomb surrounded with a rectangular stone wall structure and with plants in front of the bulging grass tomb.

A further object of the present invention is to provide a stone surround which includes a rectangular stone wall structure for supporting a bulging grass tomb, and a rectangular stone plate disposed at the middle portion and in front of the front wall and a pair of square stone plates each having a hole, respectively for growing plants therethrough and into the ground.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a stone surround for defining a grave site, which includes a rectangular stone wall structure, a stone front plate, a pair of stone plates each having a hole, respectively for growing plants therethrough from the ground.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figures 1, 2, 3, 4:
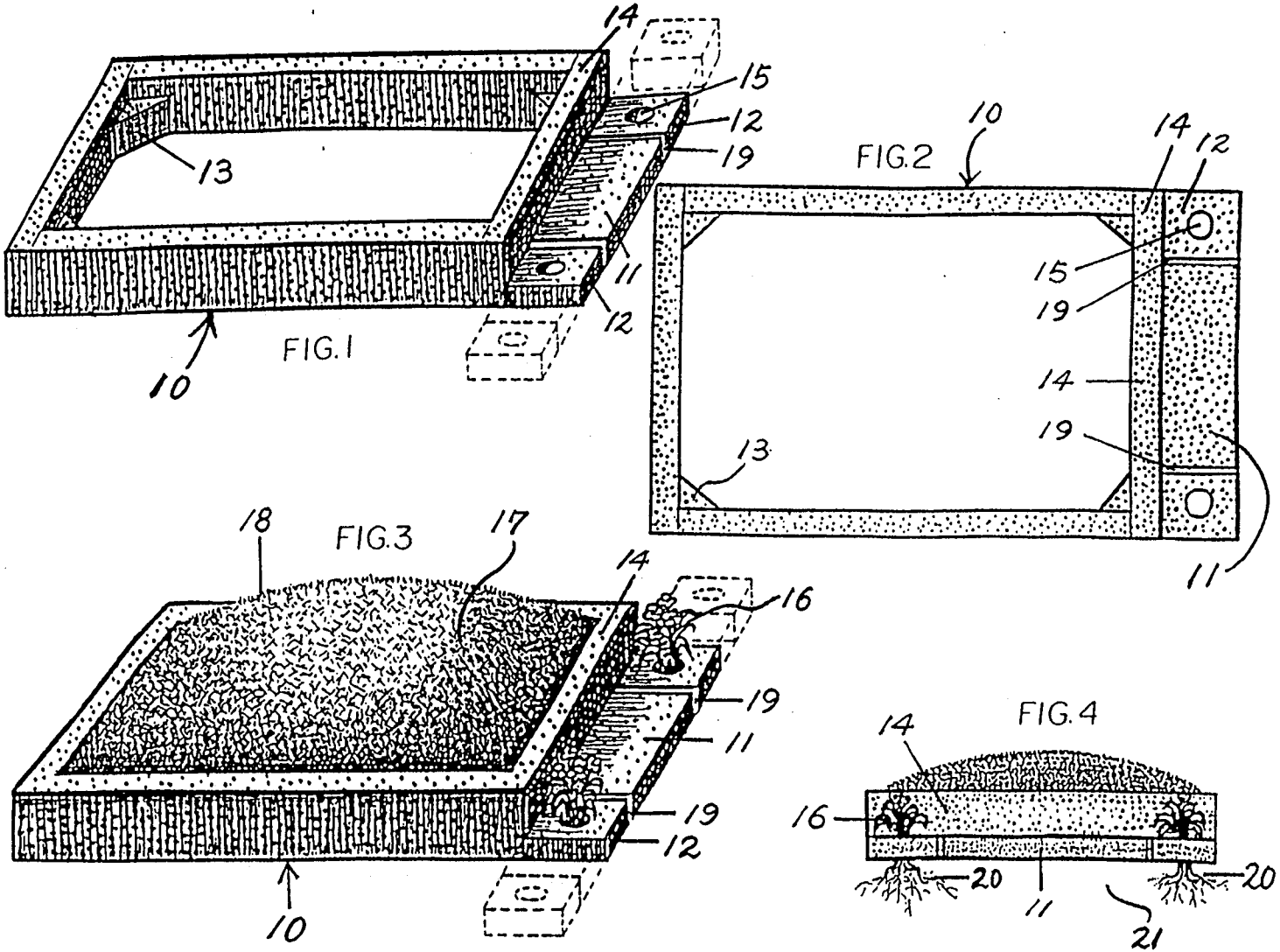
FIG. 1 is a perspective view of a stone surround for defining a grave site according to the present invention.
FIG. 2 is a top plan view of the stone surround for defining a grave site according to the present invention.
FIG. 3 is a perspective view of a grave site utilizing the stone surround with plants according to the present invention.
FIG. 4 is a front elevational view of FIG. 3.

Referring now in detail to the drawings for the purpose of illustrating preferred embodiments of the present invention, the stone surround assembly for defining a grave site as shown in FIGS. 1, 2, and 3, comprises a rectangular stone wall structure 10 including at least four rectangular cross section stones arranged in the rectangular configuration, a separately provided rectangular front stone plate 11, and a pair of separately provided stone square plates 12 having a hole 15, each disposed outside of the rectangular stone front plate 11, respectively. Therefore, a pair of spaces 19 are disposed between the rectangular stone front plate 11 and each of the stone square plates 12.

The rectangular wall structure 10 contains a corner support 13 attached to each corner, respectively. The corner support 13 is lower than the top surface of the stone wall structure 10 and is aligned with the bottom of the stone wall structure 10 so that a bulging grass tomb 17 is formed in the inside of the rectangular wall structure 10 as shown in FIG. 3.

The rectangular front stone plate 11 is located in the front of a front wall 14 of the rectangular wall structure 10 for putting some foods thereon under the tradition of oriental culture.

Each square stone plate 12 is provided with the hole 15 disposed in the center thereof for growing plants 16 therethrough. The plants 16 are grown in the ground 21 through roots 20 thereof. The square stone plates can be removable.

Referring in detail to FIGS. 5 to 8, there are illustrated an additional embodiment of a stone surround for defining a grave site in accordance with the present invention.

Figure 6:
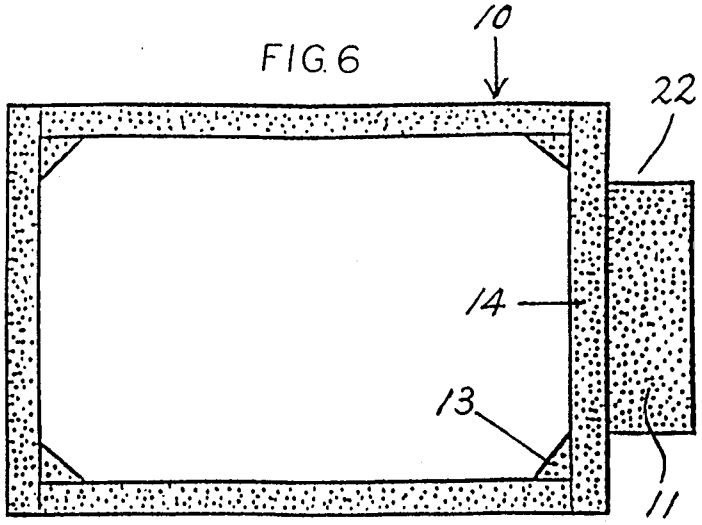
FIG. 6 is a top plan view of FIG. 5.
Figure 5:
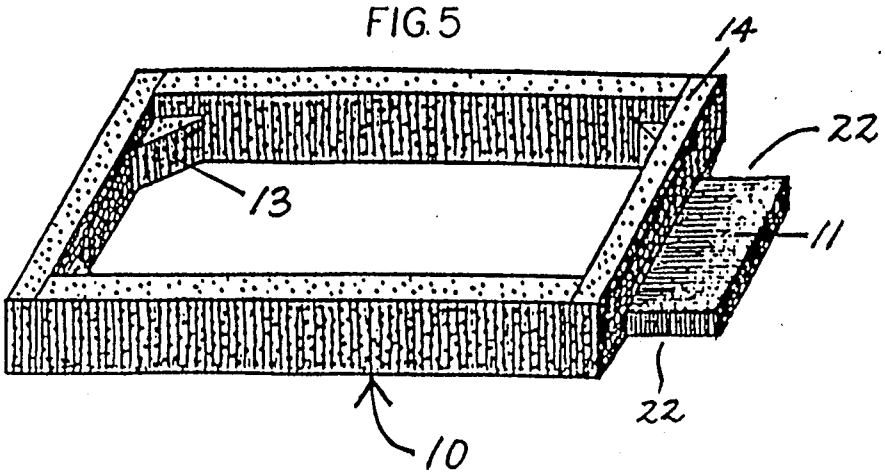
FIG. 5 is a perspective view of another embodiment of a stone surround for defining a grave site according to the present invention.

As shown in FIGS. 5 and 6, the stone surround comprises the rectangular wall structure 10 and the rectangular front stone plate 11. The rectangular wall structure 10 is supported by four corner supports 13 in the same way as FIGS. 1 and 2.

Figure 7:
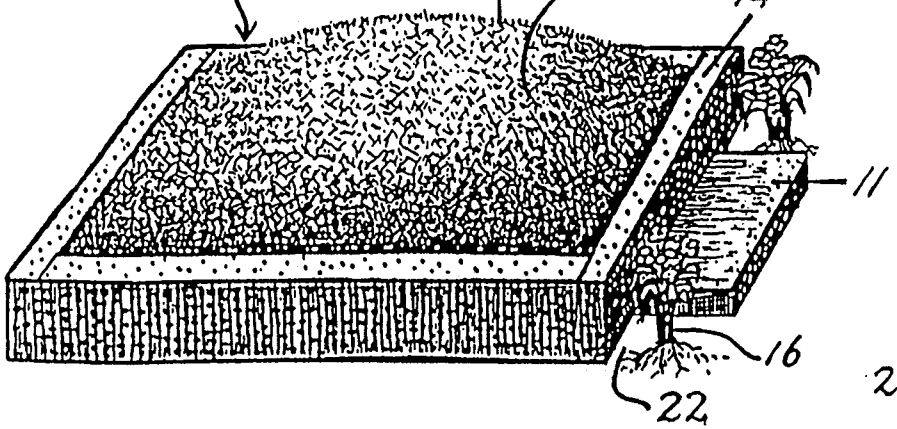
FIG. 7 is a perspective view of a gravesite utilizing the stone surround with plants according to the present invention.
Figure 8:
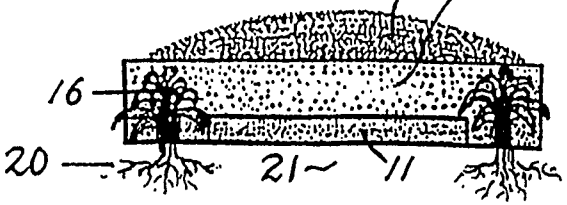
FIG. 8 is a front elevational view of FIG. 7.

The rectangular stone front plate 11 is smaller than the front wall 14 of the rectangular wall structure 10 so that a pair of spaces 22 are disposed at both outside areas of the front plate 11 for planting plants 16 disposed thereon (FIG. 7). The bulging grass tomb 17 with grass 18 is formed on the rectangular wall structure 10.

In assembly, after making a rectangular stone wall structure 10, four corner supports 13 are attached to the four corners of the rectangular stone wall structure 10. Thereafter the rectangular front stone plate 11 is attached to the front wall 14 of the stone wall structure 10. The pair of square stone plates 12 are put on both outside areas of the front stone plate 11 for forming spaces 19.

The plants 16 are planted in the ground 21 through holes 15 of the square stone plates 12. In the additional embodiment, since there are no square stone plates 12 (FIGS. 1 and 2), the plants 16 are planted in the ground directly.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A stone surround and grave site assembly for defining a grave site, which comprises:

a rectangular stone wall structure including at least four rectangular cross section stones arranged in a rectangular configuration, a rectangular front stone plate disposed on a front side of said rectangular stone wall structure, and a pair of stone plates each having a hole, respectively, and said stone plates are disposed at two ends of said rectangular front stone plate, wherein a bulging grass tomb is formed on the rectangular stone wall structure and the holes in said pair of stone plates are adapted to have a pair of plants planted therethrough.

2. The stone surround of claim 1, wherein said rectangular stone wall structure is provided with four corner supports for four corners thereof so as to retain the rectangular configuration thereof.

3. The stone surround of claim 1, wherein said rectangular front stone plate has a smaller size than a front wall of said rectangular stone wall structure.

* * * * *